United States Patent [19]

Kozlowski

[11] Patent Number: 4,885,828

[45] Date of Patent: Dec. 12, 1989

[54] METHOD AND APPARATUS FOR POSITIONING FABRIC COVERS ON A FOAM CUSHION

[75] Inventor: Eric F. Kozlowski, Rochester, Mich.

[73] Assignee: Lear Siegler Seating Corp., Southfield, Mich.

[21] Appl. No.: 270,100

[22] Filed: Nov. 14, 1988

[51] Int. Cl.[4] ..... B68G 7/00; B68G 7/12

[52] U.S. Cl. ..... 29/91.5; 29/91.7; 29/91; 112/417; 112/418; 297/452; 428/43

[58] Field of Search ..... 29/91.1, 91.5, 91.2, 29/91.3, 91.4, 91.6, 91.7; 297/452; 428/43; 2/275; 112/417, 418

[56] References Cited

U.S. PATENT DOCUMENTS 4,765,045 8/1988 Selbert ..... 29/91.1

*Primary Examiner*—Timothy V. Eley
*Assistant Examiner*—K. Jordan
*Attorney, Agent, or Firm*—Reising, Ethington, Barnard, Perry & Milton

[57] ABSTRACT

The subject invention provides a method and assembly (10) for upholstering a foam cushion (16) with fabric (12, 14). A locator strip (10) accurately positions the fabric (12) upon the cushion (16). The locator strip includes an array of U-shaped pockets (30) along one edge which are separated by finger-like projections (32). A thin fracturable filament (40) is fixedly attached to the distal end (34) of the projections (32) to enclose the pockets (30). The locator strip (10) is sewn between the edges (18, 20) of two fabrics (12, 14) with thread (36) stitches passing through the pockets (30) and around the projections (32). The locator strip (10) functions to guide the edges (18, 20) of the two fabric covers (12, 14) into an elongated slot (22) in the cushion (16). After the fabric covers (12, 14) have been bonded to the cushion (16), the locator strip (10) is pulled against the stitches and the thin filament (40) breaks and bends around the stitches so that the entire locator strip (10) is removed from the two covers (12, 14) and the cushion (16) in one piece.

12 Claims, 4 Drawing Sheets

METHOD AND APPARATUS FOR POSITIONING FABRIC COVERS ON A FOAM CUSHION

TECHNICAL FIELD

The subject invention relates to a method and assembly for upholstering a foam cushion member with two fabric covers, and more particularly to locating the sew seam of the two covers in a predetermined position on the cushion member.

BACKGROUND ART

The covering of foam cushion members with fabric for use in vehicular seats in commonly performed with automated upholstering equipment. For aesthetic purposes, it is frequently desirable to cover the cushion with two or more fabrics of different colors, patterns, etc., which have been arranged in an attractive fashion. The two or more fabric pieces are generally sewn together along their edges, with the sew seam slightly recessed into the cushion for comfort. During an automated upholstering process, however, the fabric covers have a tendency to shift out of the proper orientation on the cushion and thus mislocate the sew seams of the two or more fabrics upon the cushion.

The prior art U.S. Pat. No. 4,765,045 to Allen J. Selbert, issued Aug. 23, 1988, discloses the use of a plastic locator strip which is sewn between two pieces of fabric covering at the sew seam. The locator strip is adapted to be held in an automated tool for positively positioning the sew seam of the two fabrics into the proper orientation on the cushion. After the upholstering process is complete, the locator strip is torn from the fabric by disjoining at a pinched and perforated area thereby leaving a non-removable solid base of the locator strip underneath the sew seam which is permanently imbedded in the cushion. This reference discloses an inherently deficient upholstering process in that the solid base portion is left imbedded underneath the fabric covers, which is bothersome and uncomfortable to sit on or lean against.

SUMMARY OF THE INVENTION AND ADVANTAGES

The subject invention provides a method of covering a cushion member with fabric comprising the steps of forming an elongated slot and a cushion member, positioning a locator strip between the edges of two pieces of fabric cover, fastening the edges of the two covers to the locator strip in a plurality of spaced discrete fastened locations at least partially surrounded with a portion of the locator strip adjacent the edges, inserting the locator strip and the edges of the two covers into the slot in the cushion member, and characterized by pulling the entire portion of the locator strip surrounding the fastened locations through the void segments therebetween whereby the entire locator strip is removed from the two covers and the cushion member.

The invention also contemplates a removable locator strip assembly for upholstering a foam cushion member with two fabric covers, each of the fabric covers having edges adapted to be sewn together and received into an elongated slot in the cushion member. The assembly comprises insert means adapted to be secured between the edges of the two covers for positioning the edges of the two covers in the slot in the cushion member, extension means extending outwardly from the insert means for receiving a pulling force away from the insert means, and characterized by the insert means including detachment means for allowing the insert means to unitarily detach from the two covers in response to a pulling force applied to the extension means whereby the strip assembly is removed in one piece from the two covers and the cushion member.

The subject invention contemplates a method and assembly for properly orientating two or more fabric covers on a cushion. The subject invention overcomes the prior art by providing novel steps and structure which perform the fabric orientating process without leaving a solid base portion embedded in the cushion underneath the sew seam whereby a user of the seat will experience discomfort.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
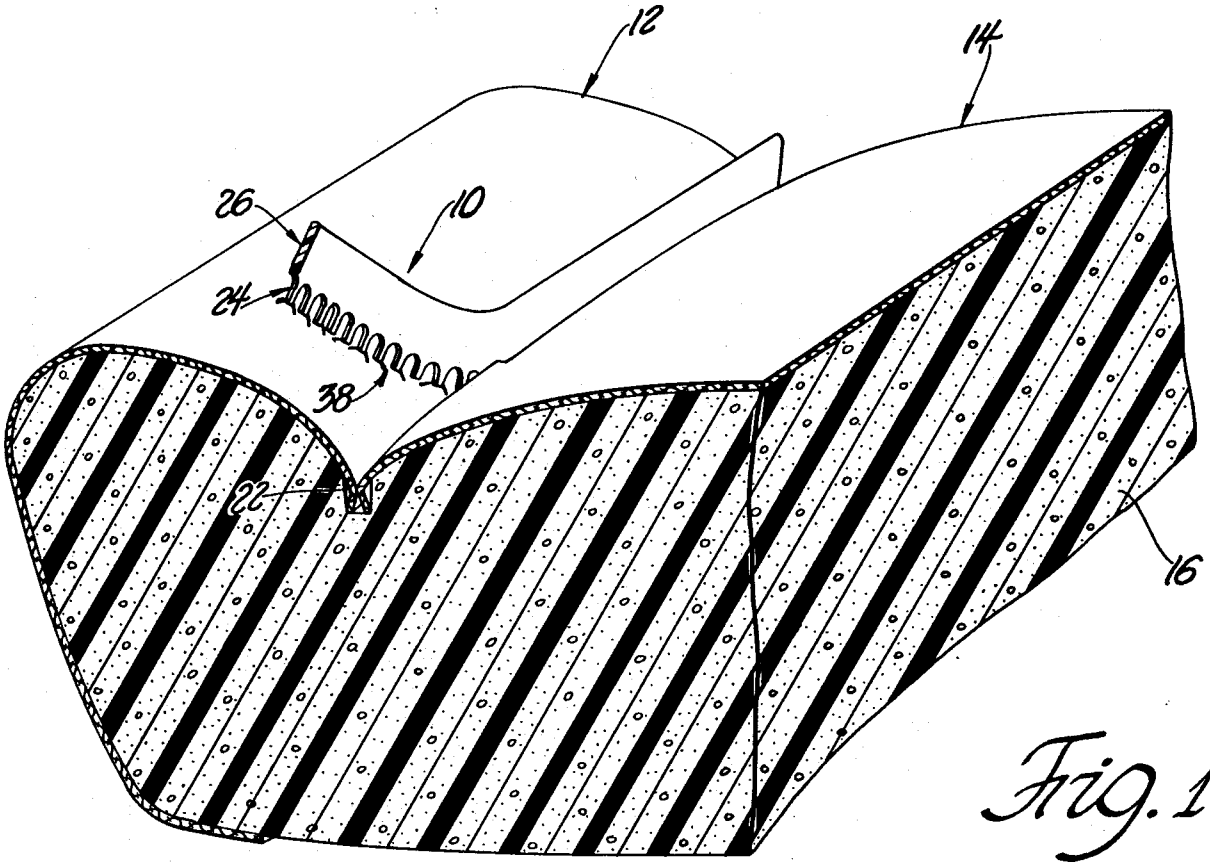
FIG. 1 is a perspective view of the subject locator strip partially detached from an upholstered cushion.

Referring to the Figures, wherein like numerals indicate like corresponding parts throughout the several views, a locator strip assembly is generally shown at 10. The locator strip 10 is particularly adapted for positioning two fabric covers, generally indicated at 12 and 14 in FIGS. 1, 5 and 6, upon a foam seat cushion 16

Preferably, the fabric covers 12 and 14 are of different colors or patterns to present an aesthetically attractive upholstered vehicular seat. Respective edges 18, 20 of the covers 12, 14 are adapted to be sewn together, with the sew seam deposited in an elongated slot 22 provided in the cushion 16. In this manner, the loose edges 18, 20 are embedded in the cushion with the two covers 12, 14 extending laterally from the sew seam leaving an attractively upholstered cushion 16.

Figure 4:
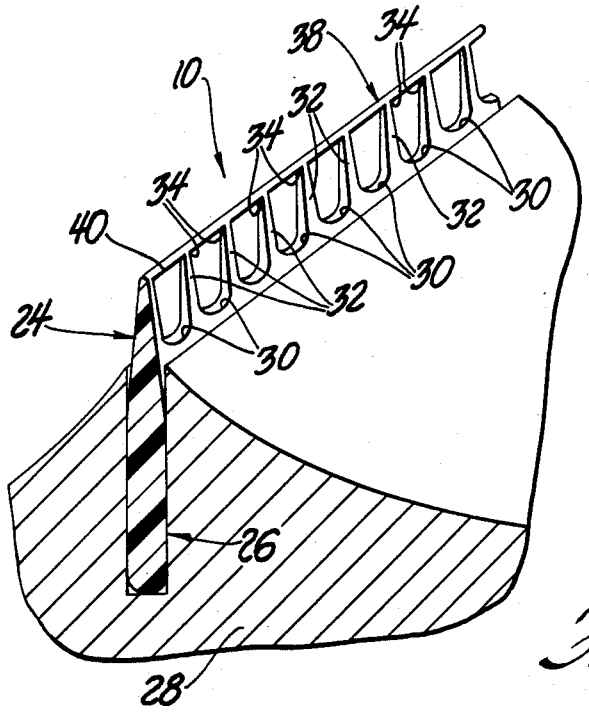
FIG. 4 is a perspective view of the locator strip supported in an automated upholstering tool.
Figure 5:
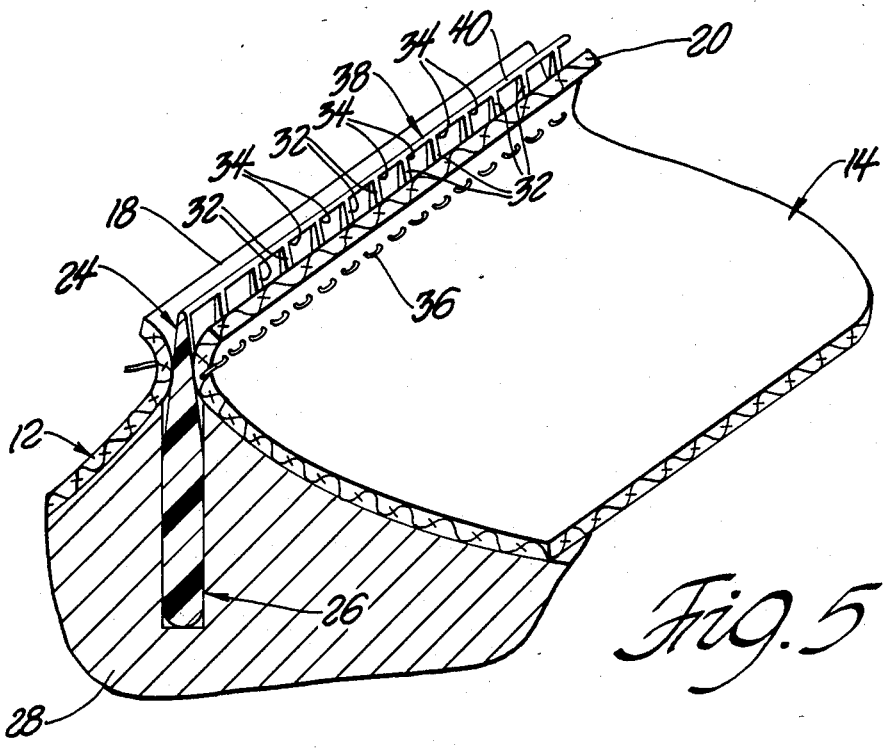
FIG. 5 is a perspective view of the locator strip sewn between the edges of two fabric covers and supported in the upholstering tool.

The locator strip 10 includes an insert means, generally indicated at 24 in FIGS. 2–5, which is adapted to be secured between the edges 18, 20 of the two covers 12, 14 for positioning the edges 18, 20 into the slot 22 in the cushion 16. As best shown in FIG. 5, the insert means 24 is sewn, or stitched, between the edges 18, 20 of the two covers 12, 14 at the same time as the two covers 12, 14 are sewn together.

An extension means, generally indicated at 26, extends outwardly from the insert means 24 for receiving a pulling force in a direction away from the insert means 24. As shown in FIGS. 4 and 5, the extension means 26 is also adapted to be supported in an automated upholstering tool 28 moveable toward and away from the cushion 16 during the automatic upholstery process, as will be described in greater detail subsequently. The extension means 26 has a generally flat rectangular cross section with rounded edges. The extension means 26 extends longitudinally of the locator strip 10.

Figure 2:
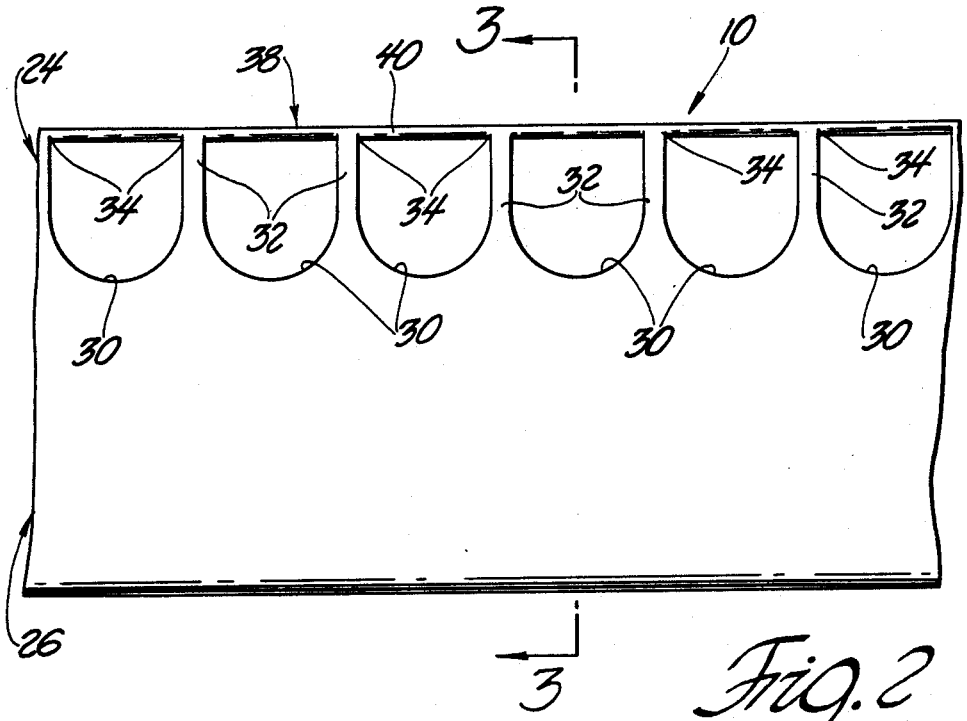
FIG. 2 is a front view of the subject locator strip.
Figure 3:
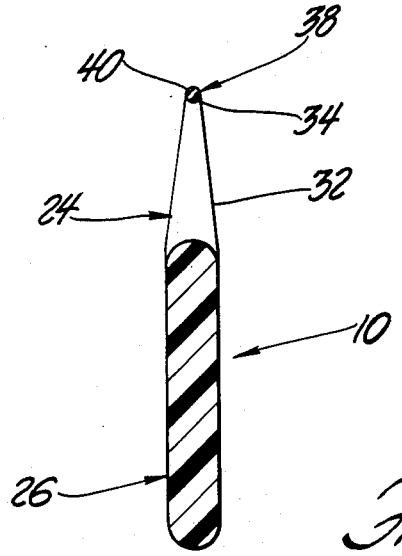
FIG. 3 is a cross-sectional end view of the locator strip taken along lines 3—3 of FIG. 2.

As best shown in FIGS. 2 and 4, the insert means 24 includes an array of U-shaped pockets 30 opening in a direction away from the extension means 26. Each adjacent pocket 30 is separated by a finger-like projection 32 which extends from the extension means 26 to a distal end 34. The projections 32 are approximately one sixth (1/6) the longitudinal span of the pockets 30. The base of the projections 32, adjacent extension means 26, flare outwardly to follow the contour of the U-shaped pockets 30.

The pockets 30 form empty spaces through which a thread 36 can pass in order to stitch the two covers 12, 14 together. That is, each time the thread 36 passes between the two covers 12, 14, it forms a discretely fastened location. The array of stitches, therefore, form a plurality of spaced discretely fastened locations which are always within the pockets 30. The thread 36 never passes through the locator strip 10, but around the projections 32 and through the open pockets 30. As will be appreciated, between each fastened location where the thread 36 passes between the two covers 12, 14, void segments, or unfastened areas, are created. The projections 32, therefore, extend through some or all of these void segments. That is, because the distance between adjacent fasten locations of the thread 36 may vary, more or less than one fastened location may be disposed through any one pocket 30.

The subject locator strip is 10 is characterized by the insert means 24 including detachment means, generally indicated at 38 in FIGS. 1–5, for allowing the insert means 24 to unitarily detach from the two covers 12, 14 in response to a pulling force applied to the extension means 26. In other words, the detachment means 38 comprises structure enabling the locator strip 10 to be removed in one piece from the two covers 12, !4 and the cushion 16 without leaving any portions remaining underneath the fabric covers 12, 14.

The detachment means 38 includes a fracturable element 40 responsive to the pulling force on the extension means 26 for unsecuring the insert means 24 from the two covers 12, 14 when fractured. The fracturable element 40 resembles an elongated filament of substantially constant cross section fixedly attached adjacent the distal ends 34 of the projections 32 to enclose the pockets 30 and fully surround the fastened locations where the two covers 12, 14 are sewn together. The diameter of the fracturable element 40 is approximately one sixteenth (1/16) the longitudinal span of the pockets 30 and approximately one third (⅓) the longitudinal span of the projections 32. The fracturable element 40 is disposed on the opposite side of the sew seam from the extension means 26 so that as the extension means 26 is pulled to detach the locator strip 10 from the sew seam, the fracturable element 40 breaks at one location between adjacent projections 32. The fracturable element 40 then pulls through the sew seam as the broken portions deflect around the fastened thread 36 locations and through the void segments therebetween without leaving any portion of the locator strip 10 behind the sew seam in the groove 22 of the cushion 16. As illustrated in FIG. 1, the fracturable element 40 remains attached to the distal ends 34 of each of the projections 32 during and after removal.

Preferably, the subject locator strip 10 is fabricated from a homogeneous organic polymeric material, such as medium density polyethylene.

Turning now to the preferred method for covering a cushion 16 with fabric covers 12, 14, the upholstering operation incorporating the locator strip 10 will be addressed presently. The elongated slot, or groove, 22 is first formed in the cushion 16 in the exact location desired to receive the sew seam between the two covers 12, 14. The locator strip 10 is then positioned between the edges 18, 20 of the two covers 12, 14. The edges 18, 20 of the covers 12, 14 are fastened together about the insert means 24 of the locator strip 10 using the thread 36 by passing in and out between the covers 12, 14 in a typical sewing fashion. As mentioned above, the thread 36 passes through the pockets 30 and around the projections 32.

Figure 6:
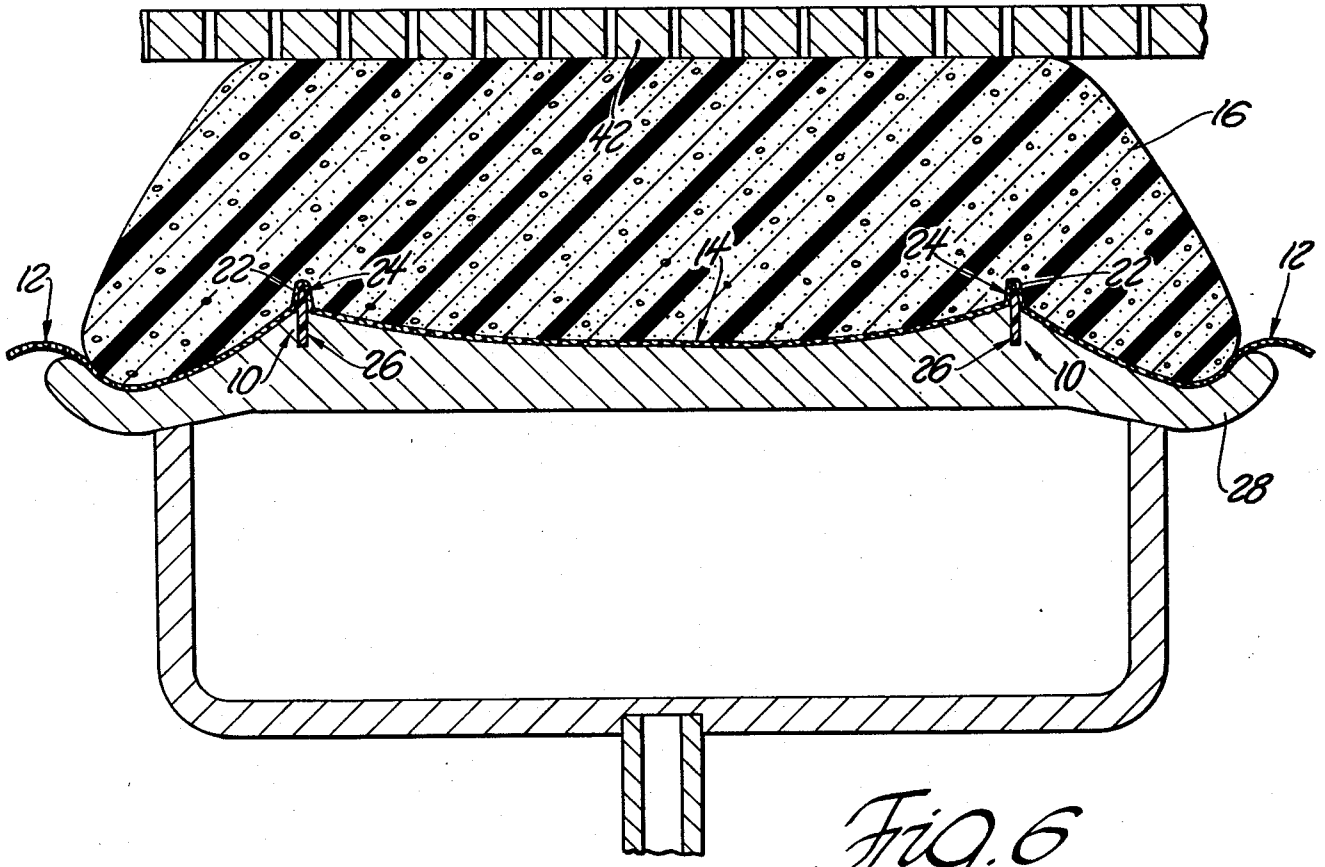
FIG. 6 is a cross-sectional view of an automated upholstering installation including two locator strips positioning three fabric covers on a cushion.

The extension means 26 of the locator strip 10 is then supported in an automated upholstering tool 28 which preferably takes the form of a heatable mold for activating a heat sensitive bonding agent to bond the fabric covers 12, 14 to the cushion 16. As shown in FIG. 6, the cushion 16 may be supported adjacent a suction plate 42 in an orientation facing the tool 28. The tool 28 and suction plate 42 are then moved toward each other, relatively, until the insert means 24 penetrates the slot 22 in the cushion 16 to exactly position the covers 12, 14 upon the cushion 16. The fabric covers 12, 14 are next adhesively bonded to the outer surface of the cushion 16, as described above or in any other manner well known in the art.

Once the fabric covers 12, 14 have been bonded to the exterior of the cushion 16, as shown in FIG. 1, the seat assembly is removed from the automatic upholstering equipment and the locator strip 10 remains secured to the sew seam and partially embedded in the groove 22. As soon as the bonding agent between the fabric covers 12, 14 and the cushion 16 has sufficiently cured, the locator strip 10 is removed by applying a pulling force upon the extension means 26 in a direction away from the insert means 24 and the sew seam. With this, the fracturable element 40 of detachment means 38 fractures in one location between every two adjacent projections 32 and the fracturable element 40 is pulled through the void segments between the fastened thread 36 locations. In other words, the fracturable element 40 never becomes detached from the distal ends 34 of each of the projections 32. Instead, the fracturable element 40 breaks at one location between adjacent projection 32 and the broken segments deflect around the thread 36 stitches and slide, with the projections 3,, through the void segments in the sew seam. In this manner, the entire locator strip 10 is removed from the two covers 12, 14 and the cushion 16 so that no portion is left embedded in the slot 22. Said another way, the fracturable element 40 breaks as it is pulled through the sew seam, but remains attached to the locator strip 10 for removal therewith through the sew seam.

The end result of upholstering a cushion 16 by utilizing the subject locator strip 10 results in an attractive and comfortable seat due to the perfectly orientated fabric covers 12, 14 and the absence of any solid portion of the locator strip 10 left embedded in the cushion 16 below the covers 12, 14.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of covering a cushion member (16) with fabric (12, 14) comprising the steps of: forming an elongate slot (22) in a cushion member (16); positioning a locator strip (10) between the edges (18, 20) of two pieces of fabric cover (12, 14); fastening the edges (18, 20) of the two covers (12, 14) to the locator strip (10) in a plurality of spaced discrete fastened locations at least partially surrounded with a portion of the locator strip (10) adjacent the edges (18, 20) with void unfastened segments extending between adjacent fastened locations; inserting the locator strip (10) and the edges (18, 20) of the two covers (12, 14) into the slot (22) in the cushion member (16); and characterized by pulling the entire portion of the locator strip (10) surrounding the fastened locations through the void unfastened segments therebetween whereby the entire locator strip (10) is removed from the two covers (12, 14) and the cushion member (16).

2. A method as set forth in claim 1 further characterized by the step of fastening further defined as stitching the edges (18, 20) of the two covers (12, 14) to the locator strip (10) with a flexible thread (36) to form the discrete fastened locations separated by the void unfastened segments.

3. A method as set forth in claim 2 further characterized by the step of fastening further defined as stitching the edges (18, 20) of the two covers (12, 14) to each other through the locator strip (10).

4. A method as set forth in claim 3 further characterized by the step of pulling the entire portion of the locator strip (10) through the void unfastened segments further defined as fracturing the portion (40) of the locator strip (10) surrounding the fastened locations to facilitate withdrawal around and between the fastened locations.

5. A method as set forth in claim 4 further characterized by including the step of attaching the fabric covers (12, 14) to the cushion member (16).

6. A method as set forth in claim 5 further characterized by the step of inserting the locator strip (10) and the edges (18, 20) of the two covers (12, 14) into the slot (22) in the cushion member (16) including the step of supporting the locator strip (10) in a positioning tool (28) adapted for relative movement toward the cushion member (16).

7. A removable positioning strip assembly (10) for upholstering a foam cushion member (16) with two fabric covers (12, 14), each of the covers (12, 14) having edges (18, 20) adapted to be sewn together and received into an elongated slot (22) in the cushion member (16), comprising: insert means (24) adapted to be secured between the edges (18, 20) of the two covers (12, 14) for positioning the edges (18, 20) of the two covers (12, 14) into the slot (22) in the cushion member (16); extension means (26) extending outwardly from said insert means (24) for receiving a pulling force in a direction away from said insert means (24); and characterized by said insert means (24) including detachment means (38) for allowing said insert means (24) to unitarily detach from the two covers (12, 14) in response to a pulling force applied to said extension means (26) whereby said strip assembly (10) is entirely removed in one piece from the two covers (12, 14) and the cushion member (16).

8. An assembly (10) as set forth in claim 7 further characterized by said detachment means (38) including a fracturable element (40) responsive to the pulling force on said extension means (26) for unsecuring said insert means (24) from the two covers (12, 14) upon fracture.

9. An assembly (10) as set forth in claim 8 further characterized by said insert means (24) including an array of U-shaped pockets (30) opening in a direction away from said extension means (28) and separated by finger-like projections (32) extending from said extension means (26) to a distal end (34).

10. An assembly (10) as set forth in claim 9 further characterized by said fracturable element (40) of said detachment means (38) including an elongated filament of substantially constant cross-section fixedly attached adjacent said distal ends (34) of said projections (32) to enclose said pockets (30) and surround the locations where the two covers (12, 14) are sewn together.

11. An assembly (10) as set forth in claim 10 further characterized by said extension means (26) having a generally rectangular cross section extending longitudinally of said assembly (10).

12. An assembly (10) as set forth in claim 11 further characterized by said assembly (10) being fabricated from a homogenous organic polymeric material.

* * * * *